US008100745B2

(12) United States Patent
Zhang et al.

(10) Patent No.: US 8,100,745 B2
(45) Date of Patent: Jan. 24, 2012

(54) LOW VIBRATION SANDER WITH A FLEXIBLE TOP HANDLE

(75) Inventors: Qiang J. Zhang, Baltimore, MD (US); Daniel H. Sides, Jr., New Freedom, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/724,704

(22) Filed: Mar. 16, 2007

(65) Prior Publication Data

US 2008/0227373 A1 Sep. 18, 2008

(51) Int. Cl.
*B24B 23/04* (2006.01)

(52) U.S. Cl. ..... 451/357; 16/431; 451/344

(58) Field of Classification Search ..... 451/357, 451/353, 356, 449, 451, 453, 344; 16/431
See application file for complete search history.

(56) References Cited

U.S. PATENT DOCUMENTS 1,800,341 A 4/1931 Davies
2,639,564 A 5/1953 Atkin
2,942,384 A 6/1960 Higley
3,322,211 A * 5/1967 Alabuzhev et al. ..... 173/162.2
3,698,455 A * 10/1972 Frederickson et al. ..... 30/381
3,889,763 A * 6/1975 Dillon ..... 173/162.1
4,145,848 A 3/1979 Hutchins
4,282,768 A * 8/1981 Osborn ..... 74/473.29
4,322,921 A 4/1982 Maier
4,467,565 A * 8/1984 Wallace et al. ..... 451/357
4,478,293 A * 10/1984 Weilenmann et al. ..... 173/162.2
4,531,329 A 7/1985 Huber
4,660,329 A * 4/1987 Hutchins ..... 451/357
4,671,019 A * 6/1987 Hutchins ..... 451/357
4,711,308 A * 12/1987 Blaas et al. ..... 173/162.2
4,727,682 A 3/1988 Stabler et al.
4,729,195 A 3/1988 Berger
4,754,575 A 7/1988 Schneider
4,759,152 A 7/1988 Berger et al.
4,800,965 A * 1/1989 Keller ..... 173/162.2
4,986,036 A * 1/1991 Hutchins ..... 451/344
5,018,314 A 5/1991 Fushiya et al.
5,125,189 A * 6/1992 Holmin et al. ..... 451/344
5,261,190 A 11/1993 Berger et al.
5,269,381 A * 12/1993 Oscarsson ..... 173/162.2
5,361,500 A * 11/1994 Naslund et al. ..... 30/381
5,392,568 A 2/1995 Howard et al.
5,522,466 A * 6/1996 Harada et al. ..... 173/162.2
5,637,034 A * 6/1997 Everts et al. ..... 451/344
5,681,213 A * 10/1997 Hashii ..... 451/356
5,697,456 A * 12/1997 Radle et al. ..... 173/162.2
(Continued)

FOREIGN PATENT DOCUMENTS

GB 2086005 A * 5/1982
(Continued)

*Primary Examiner* — Timothy V Eley
(74) *Attorney, Agent, or Firm* — Brake Hughes Bellermann LLP

(57) ABSTRACT

A power tool includes a tool body, and the tool body is subject to vibration during operation of the power tool. The power tool also includes a handle adapted to be grasped by an operator of the power tool for controlling the motion of the power tool, and at least one coupling member, where each coupling member includes a first end coupled to the tool body and a second end coupled to the handle and a longitudinal axis between the first end and the second end.

17 Claims, 11 Drawing Sheets

U.S. PATENT DOCUMENTS

| | | | | |
|---|---|---|---|---|
| 5,823,862 | A * | 10/1998 | Heidelberger | 451/344 |
| 5,868,208 | A * | 2/1999 | Peisert et al. | 173/178 |
| 5,919,085 | A * | 7/1999 | Izumisawa | 451/357 |
| 5,921,854 | A * | 7/1999 | Evensen | 451/504 |
| 5,941,765 | A | 8/1999 | Taylor | |
| 6,042,460 | A * | 3/2000 | Bosten et al. | 451/356 |
| 6,148,930 | A * | 11/2000 | Berger et al. | 173/162.2 |
| 6,155,916 | A * | 12/2000 | Rudolf et al. | 451/344 |
| 6,375,171 | B1 * | 4/2002 | Zimmermann et al. | 267/137 |
| 6,447,383 | B2 * | 9/2002 | Oda et al. | 451/357 |
| 6,926,595 | B2 * | 8/2005 | Pollak et al. | 451/270 |
| 6,974,370 | B2 * | 12/2005 | Hutchins | 451/357 |
| 7,076,838 | B2 * | 7/2006 | Meixner | 16/431 |
| 7,207,872 | B2 | 4/2007 | Lamprecht et al. | |
| 7,287,601 | B2 * | 10/2007 | Hellbach et al. | 173/162.2 |
| 7,523,790 | B2 * | 4/2009 | Arakawa et al. | 173/162.2 |
| 7,610,967 | B2 * | 11/2009 | Fischer et al. | 173/162.2 |
| 7,676,890 | B2 * | 3/2010 | Zhang et al. | 16/431 |
| 7,740,087 | B2 * | 6/2010 | Krondorfer et al. | 173/210 |
| 2003/0006051 | A1 * | 1/2003 | Schmitzer et al. | 173/49 |
| 2003/0132016 | A1 * | 7/2003 | Meixner et al. | 173/162.2 |
| 2003/0220058 | A1 * | 11/2003 | Pollak et al. | 451/357 |
| 2004/0040729 | A1 * | 3/2004 | Meixner | 173/162.2 |
| 2004/0229555 | A1 * | 11/2004 | Hutchins | 451/357 |
| 2005/0247464 | A1 * | 11/2005 | Hellbach et al. | 173/162.2 |
| 2006/0011365 | A1 * | 1/2006 | Stirm et al. | 173/162.2 |
| 2006/0185867 | A1 * | 8/2006 | Frauhammer et al. | 173/162.1 |
| 2006/0219419 | A1 * | 10/2006 | Sugiyama et al. | 173/162.2 |
| 2007/0034396 | A1 * | 2/2007 | Berger et al. | 173/162.2 |
| 2010/0269625 | A1 * | 10/2010 | Zhang et al. | 74/551.9 |

FOREIGN PATENT DOCUMENTS

| | | |
|---|---|---|
| GB | 2405821 | 3/2005 |
| GB | 2420732 | 6/2006 |

* cited by examiner

LOW VIBRATION SANDER WITH A FLEXIBLE TOP HANDLE

TECHNICAL FIELD

This description relates to vibration damping and, in particular, to a low vibration sander with a flexible top handle.

BACKGROUND

Power tools and other power apparatuses can generate substantial vibration during operation. Power tools may include, for example, reciprocating and/or rotating parts, such as, for example, motors, fan blades, bits, discs, and belts, which can cause the tool to vibrate during operation. An operator holding the tool can experience fatigue, pain, or injury because of the tool's vibration.

One example of a power tool that exhibits vibration during operation is a random orbital sander, which can be used in a variety of applications where it is desirable to obtain a smooth surface free of scratches and swirl marks. Such applications typically involve wood working applications such as furniture construction or vehicle body repair applications, just to name a few.

Random orbital sanders typically include a platen that is driven rotationally by a motor-driven spindle. The platen is driven by a freely rotatable bearing that is eccentrically mounted on the end of the drive spindle. Rotation of the drive spindle causes the platen to orbit about the drive spindle while frictional forces within the bearing, as well as varying frictional loads on the sanding disc attached to the platen, cause the platen to also rotate about the eccentric bearing, thereby imparting the "random" orbital movement to the platen. Such random orbit sanders often also include a fan member that is driven by the output shaft of the motor. The fan member is adapted to draw dust and debris generated by the sanding action up through openings formed in the platen and into a filter or other like dust collecting receptacle.

One such prior art random orbital sander is disclosed in U.S. patent application Ser. No. 11/103,928, the entire disclosure of which is incorporated herein by reference for all purposes. For context, a short section of the '928 application describing a random orbital sander is repeated here. With reference to FIG. 9, a random orbital sander 10 generally includes a housing 12 that includes a two-piece upper housing section 13 and a two-piece shroud 14 at a lower end thereof. Removably secured to the shroud 14 is a dust canister 16 for collecting dust and other particulate matter generated by the sander during use. A platen 18 having a piece of sandpaper 19 (shown in FIG. 10) releasably adhered thereto is disposed beneath the shroud 14. The platen 18 is adapted to be driven rotationally and in a random orbital pattern by a motor disposed within the upper housing 13. The motor (shown in FIG. 10) is turned on and off by a suitable on/off switch 20 that can be controlled easily with a finger of one hand while grasping the upper end portion 22 of the sander. The upper end portion 22 further includes an opening 26 formed circumferentially opposite that of the switch 20 through which a power cord can extend.

The shroud 14 can be is rotatably coupled to the upper housing section 13 so that the shroud 14, and hence the position of the dust canister 16, can be adjusted for the convenience of the operator. The shroud section 14 further includes a plurality of openings 28 (only one of which is visible in FIG. 9) through which a cooling fan driven by the motor within the sander can expel air drawn into and along the interior area of the housing 12 to help cool the motor.

With reference now to FIG. 10, the motor can be seen and is designated generally by reference numeral 30. The motor 30 includes an armature 32 having an output shaft 34 associated therewith. The output shaft or drive spindle 34 is coupled to a combined motor cooling and dust collection fan 36. In particular, the fan 36 includes a disc-shaped member having impeller blades formed on both its top and bottom surfaces. The impeller blades **36*a* formed on the top surface of the fan serve as the cooling fan for the motor, and the impeller blades 36*b* formed on the bottom surface of the fan serve as the dust collection fan for the dust collection system. Openings 18*a* formed in the platen 18 allow the fan 36*b* to draw sanding dust up through aligned openings 19*a* in the sandpaper 19 into the dust canister 16 to thus help keep the work surface clear of sanding dust. The platen 18 is secured to a bearing retainer 40 via a plurality of threaded screws 38 (only one of which is visible in FIG. 10) that extend through openings 18*b* in the platen 18. The bearing retainer 40 carries a bearing 42 that is journalled to an eccentric arbor 36*c* formed on the bottom of the fan member 36. The bearing assembly is secured to the arbor 36*c* via a threaded screw 44 and a washer 46. It will be noted that the bearing 42 is disposed eccentrically to the output shaft 34 of the motor, which thereby imparts an orbital motion to the platen 18 as the platen 18 is driven rotationally by the motor 30**.

With further reference to FIG. 10, a braking member 48 is disposed between a lower surface 50 of the shroud 14 and an upper surface 52 of the platen 18. The braking member 48 can include an annular ring-like sealing member that effectively seals the small axial distance between the lower surface 50 of the shroud 14 and the upper surface 52 of the platen 18.

With reference to FIG. 11, the braking member 48 includes a base portion 54 having a generally planar upper surface 56, a groove 58 formed about the outer circumference of the base portion 54, a flexible, outwardly flaring wall portion 60 having a cross sectional thickness of preferably about 0.15 mm, and an enlarged outermost edge portion 62. The groove 58 engages an edge portion 64 of an inwardly extending lip portion 66 of the shroud 14, which secures the braking member 48 to the lip portion 66. In FIGS. 10 and 11, the outermost edge portion 62 is illustrated as riding on an optional metallic (e.g., stainless steel) annular ring 61 that is secured to the backside 52 of the platen 18. Alternatively, the entire backside of the platen 18 may be covered with a metallic or stainless steel sheet. While optional, the stainless steel annular ring or sheet 61 can serve to substantially eliminate the wear that might be experienced on the upper surface 52 of the platen 18 if the outermost edge portion 62 were to ride directly thereon.

SUMMARY

In a first general aspect, a power tool includes a tool body, and the tool body is subject to vibration during operation of the power tool. The power tool also includes a handle adapted to be grasped by an operator of the power tool for controlling the motion of the power tool, and at least one coupling member, where each coupling member includes a first end coupled to the tool body and a second end coupled to the handle and a longitudinal axis between the first end and the second end.

Implementations can include one or more of the follow features. For example, the handle can include a top surface facing away from the tool body and can be adapted to fit into the palm of a hand of the operator, such that the operator can grasp the handle with a single hand to control the movement and operation of the power tool. The power tool can include a sanding platen adapted for receiving an abrasive material for sanding a workpiece and a motor coupled to the sanding platen and adapted to move the platen while the operator grasps the handle. The motor is can be adapted to move the platen in a random orbit motion. The sanding platen can be adapted for receiving an abrasive material for sanding a workpiece, and the tool can include a fan coupled to the sanding platen and an orifice adapted for receiving a stream of air that is channeled within the tool body to drive the fan and cause the sanding platen to move while the operator grasps the handle.

During operation of the power tool, the tool body can vibrate at a primary vibration frequency, and a natural frequency of a first-order transverse vibrational mode of the handle when grasped by a hand of the operator can be lower than the primary vibration frequency. During operation of the power tool, the tool body can vibrate at a primary vibration frequency, and a natural frequency of a second-order transverse vibrational mode of the handle when grasped by a hand of the operator can be lower than the primary vibration frequency. At least of the one coupling members can include a resilient material, such that the collective response of the coupling members to vibration can be characterized by a collective spring constant and wherein the square root of the collective spring constant divided by the sum of the mass of the handle is less than a primary vibration frequency at which the tool body vibrates during operation of the power tool. The handle can be separated from contact with the tool body during normal operation of the power tool. The tool body can include a first flange extending transversely from the tool body, and the handle can include a second flange extending substantially parallel to the first flange, and the first flange can be located substantially between the second flange and the handle.

In another general aspect, a powered sanding tool includes a tool body, a sanding platen, a handle, and at least one coupling member. The tool body is subject to vibration during operation of the power tool. The sanding platen is adapted for receiving an abrasive material for sanding a workpiece. The handle is adapted to be grasped by an operator of the power tool for controlling the motion of the power tool. Each coupling member includes a first end coupled to the tool body and a second end coupled to the handle and a longitudinal axis between the first end and the second end. During operation of the power tool, the tool body vibrates at a primary vibration frequency, and a natural frequency of a first order transverse vibrational mode of the handle when grasped by a hand of the operator is lower than the primary vibration frequency.

Implementations can include one or more of the follow features. For example, the handle can include a top surface facing away from the tool body and can be adapted to fit into the palm of a hand of the operator, such that the operator can grasp the handle with a single hand to control the movement and operation of the power tool The tool can include a motor coupled to the sanding platen and adapted to move the platen while the operator grasps the handle, and the motor can be adapted to move the platen in a random orbit motion. The tool can include a fan coupled to the sanding platen and an orifice adapted for receiving a stream of air that is channeled within the tool body to drive the fan and cause the sanding platen to move while the operator grasps the handle. The motor can be adapted to move the platen in a random orbit motion.

During operation of the power tool the tool body can vibrates at a primary vibration frequency, and a natural frequency of a second order transverse vibrational mode of the handle when grasped by a hand of the operator can be lower than the primary vibration frequency. Displacement of the handle in the first- and second-order vibrational modes can be substantially transverse to an longitudinal axis of an elongated coupling member. The coupling members can include a resilient material, and a collective response of the coupling members to vibration can be characterized by a collective spring constant, where the square root of the collective spring constant divided by the sum of the mass of the handle is less than a primary vibration frequency at which the tool body vibrates during operation of the power tool. The tool body can include a first flange extending transversely from the tool body, and the handle can include a second flange extending substantially parallel to the first flange, and the first flange can be located substantially between the second flange and the handle, and the handle can be separated from contact with the tool body during normal operation of the power tool.

The details of one or more implementations are set forth in the accompanying drawings and the description below. Other features will be apparent from the description and drawings, and from the claims.

DETAILED DESCRIPTION

Figure 1:
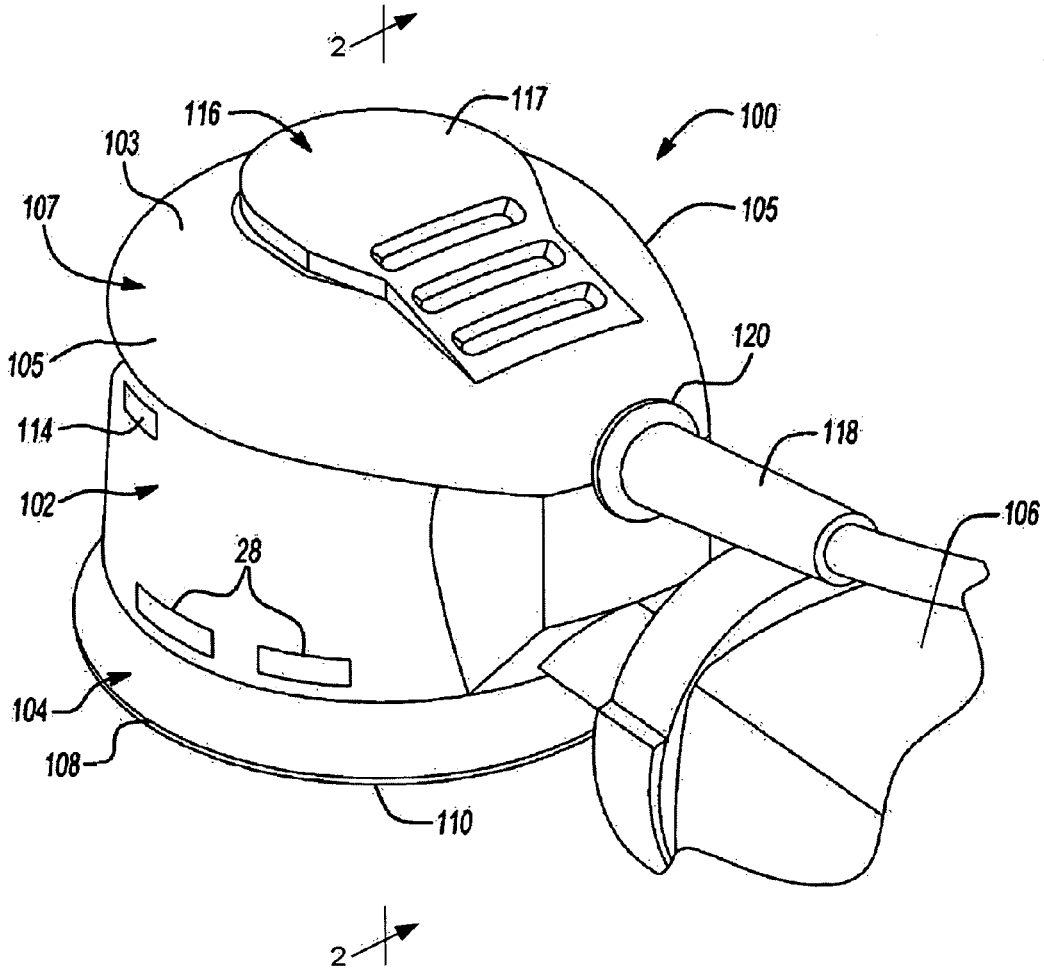
FIG. 1 is perspective topside view of an example power tool.
Figure 1:
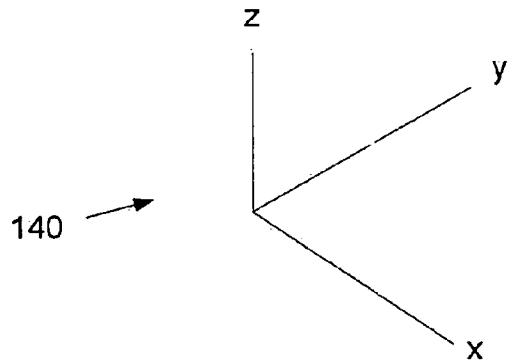

FIG. 1 is perspective topside view of an example power tool 100. The power tool 100 will be described in the context of a random orbital sander and may be referred to as a sander 100, but it should be understood that it can be other types of power tools that exhibit some vibration when operated (e.g., orbital sanders (which are sometimes known as "quarter sheet" sanders), buffers, polishers, routers, and grinders) are also contemplated for use with the implementations described herein.

In the example shown in FIG. 1, as explained above, the power tool 100 can be a random orbit sander that includes a body 102 and an orbit mechanism 104. The orbit mechanism 104 is disposed beneath the body 102, and a dust canister 106 for collecting dust generated during operation may be attached to the body 102.

The orbit mechanism 104 is adapted to be driven rotationally and in a random orbital pattern by a motor 112 (shown in FIG. 2) disposed within the body 102. The motor 112 can turned on and off by a suitable on/off switch 114. In one implementation, the speed of the motor 112 can be controlled by a trigger switch 116 that may be coupled to a potentiometer that controls the amount of electrical power used to drive the motor 112. The trigger switch 116 may be, for example, a paddle switch having a paddle type actuator member 117 shaped generally to conform to a palm of a user's hand. It should be understood, however, that the trigger switch 116 could also include the on/off switch 114. The sander 100 can be a corded sander and may include a power cord 118 for connecting the sander to a source of electrical energy (e.g., an AC mains power supply) to provide power to the motor 112 within the body 102. In another implementation, the on/off switch 114 or the trigger switch 116 may be a multi-position switch to control the amount of power supplied to the motor in discrete steps, which, in turn, can control the speed, frequency, force, amplitude (or some other physical parameter) with which the sander operates. In another implementation, the trigger switch 116 may continuously vary the amount of electrical power supplied to the motor over a range of possible powers.

The orbit mechanism 104 supports a pad or platen 108 adapted for holding sandpaper or other abrasives or materials (e.g., polishing or buffing platens) that a user may desire to use on a workpiece. The platen 108 can be configured with a pressure sensitive adhesive or a hook-and-loop arrangement for receiving a sheet of sandpaper. The platen 108 can include holes through which sanding dust can be extracted from the surface of the workpiece and exhausted to a collection unit (e.g., a dust bag or dust canister) 106. Alternatively, the platen 108 may not include holes. The platen 108 has an outer periphery that substantially defines the size of the sandpaper or other material that is supported by the platen. According to a coordinate system 140, the platen 108 lies in a plane defined by the x- and y-axes of the coordinate system, and the z-axis is perpendicular to the bottom surface of the platen 108.

Figure 2:
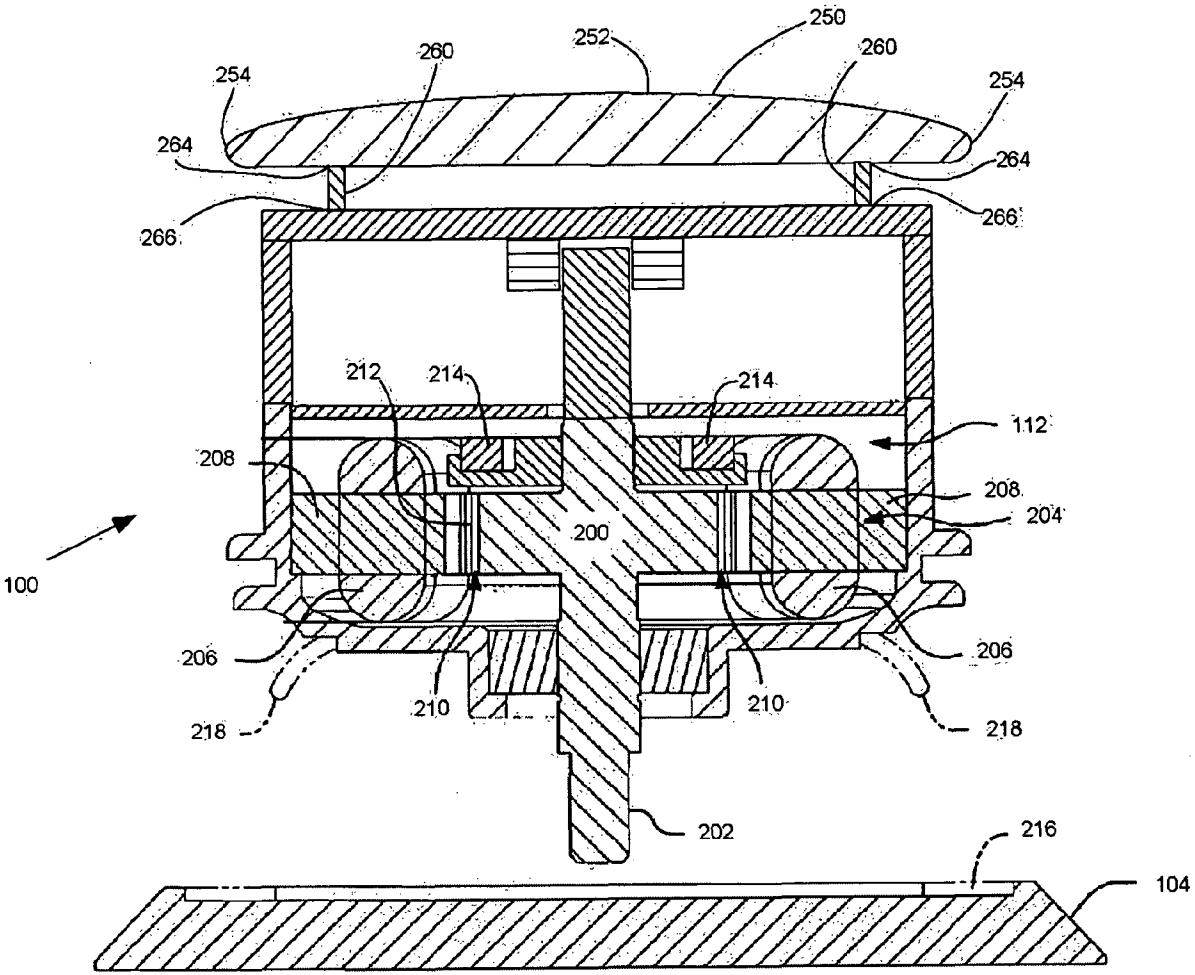
FIG. 2 is a schematic cross-sectional view of the power tool of FIG. 1 taken along the line 2-2, where the tool has coupling members that couple a handle to the body of the tool.

FIG. 2 is a schematic cross-sectional view of the sander 100 shown in FIG. 1. The motor 112 can be an electronically commutated motor having a rotor 200 with an output shaft associated therewith to which the orbit mechanism 104 can be coupled in conventional fashion, such as disclosed in U.S. Pat. No. 5,392,568, or in U.S. patent application Ser. No. 11/103,928, both of which are incorporated herein by reference for all purposes. The motor 112 may be, for example, an electronically commutated motor of the type known as brushless DC motors (which is somewhat of a misnomer as the electronic commutation generates AC waveforms, when viewed over a full turn of the motor, that excite the motor). The motor 112 also may be, for example, an electronically commutated motor of the type known as AC synchronous motors that are excited with sinusoidal waveforms.

The motor 112 includes a stator 204 having a plurality of windings 206 wound about lamination stacks 208. Lamination stacks 208 are formed in conventional fashion and may be a single stack or a plurality of stacks. The rotor 200 includes a plurality of magnets 210 disposed around its periphery 212. Position sensors 214 can be mounted in the body 102 about the rotor 200 to sense the angular position of the rotor 200. The position sensors 214 can be, for example, Hall Effect sensors with three position sensors spaced 120 degrees about the rotor 200.

In an implementation, the sander 100 may include a mechanical braking member, such as brake member 218 and corresponding ring 216 (shown in phantom in FIG. 2) of the type described in U.S. Pat. No. 5,392,568. The brake member 218 is a flexible member that contacts the ring 216 on the backside of the orbit mechanism 104 during operation of the sander 100 to limit the rotational speed of the platen 104.

In another implementation of the sander 100, rather than being powered by an electrical motor the sander may be powered pneumatically by a stream of liquid (e.g., air or water) that enters the body 102 of the tool to provide energy to drive an air or water motor. In a pneumatic implementation, the power cord 118 could be replaced with an air or water hose, and the electrical motor 112 within the body 102 would be replaced with an air or water motor.

When powered, the motor 112 may drive a rotating, oscillating, reciprocating, vibrating, or otherwise moving member within the body 102 of the power tool 100. For example, the rotor 200 of the motor 112 can be coupled to the orbit mechanism 104 to drive the orbit mechanism and the platen 108 in a random orbit. Motors used in many implementations typically operate at a high frequency. For example, in the example implementation of a random orbit sander 100, the motor can drive a fan within the body 102 and the orbit mechanism 104 outside the body at a frequency of about 12,000 RPM, such that the platen 108 experiences orbital motion having a frequency of about 12,000 RPM. However, as is typical of random orbit sanders, the frequency of the rotational motion of the may be close to zero, such that abrasive particles on the platen 108 travel in random orbital motion to reduce swirl marks on the workpiece.

The power tool 100 also includes a handle portion 250 that can be grasped by the user to control the operation of the power tool and its interaction with the workpiece. The handle 250 of the power tool can be ergonomically shaped, such that it can be easily grasped by in the hand of the user. For example, the handle 250 may have a surface area that is about the size of, or slightly larger than, the size of a typical operator's palm. The upper surface 252 of the handle (i.e., the surface facing away from the platen 108 can be contoured to fit comfortably in the palm of the operator's hand while also allowing the fingers of the operator to wrap around the handle's side surfaces 254, such that the operator can grasp the handle comfortably. In an implementation, the upper surface 252 is shaped to have an arcuate cross-section that generally conforms with a palm of a user's hand, with side surfaces 254 curving back toward the body 102. A user can thus grip the sander 100 by holding the upper surface 252 of the handle 250 in the palm of the user's hand and grasping edges 254 with the user's fingers, which can extend under edges 254. While the upper surface 252 of the sander 100 is shown in FIGS. 1-2 as being generally round (when viewed from the top), it should be understood that the upper surface 252 can have other shapes, such as oval, teardrop, elliptical, or the like. The shape of the upper surface 252 of the handle 250 allows the user to keep the user's hand relatively open when grasping the sander 100.

In general, the handle 250 can be contoured or otherwise shaped to facilitate gripping by the hand of an operator of the power tool 100. For example, the handle 250 can be generally symmetrical about one or more axes, or the handle may have a contour that is asymmetrical about an axis, for example, to provide specific contour features accommodating the positions of the operator's fingers. More generally, the handle 250 can have a shape that is suitable for manipulation by the operator of the power tool 100 and that is comfortable and can provide adequate control of the tool when gripped by the operator. The handle 250 can be constructed, for example, of a hard plastic (e.g., acrylonitrile butadiene styrene) or any other suitably hard material using manufacturing techniques such as blow or injection molding. Furthermore, all or portions of the handle 250 can be sheathed or otherwise covered with a resilient or elastomeric material (e.g., rubber, neoprene, or a silicone-based gel) to improve the comfort of the operator's grip on the handle.

As explained in more detail below, rather than the handle 250 being rigidly bound to the body 102 of the sander 100, the handle 250 can be loosely coupled to the body through one or more, semi-rigid, resilient coupling members 260. Because of the loose coupling, the handle 250 can be displaced slightly while the body 102 remains stationary, or, conversely, the handle 250 can remain relatively stationary while the body experiences vibration. Thus, the loose coupling between the handle 250 and the body 102 can reduce the amplitude of vibrational motion experienced by the operator when operating the power tool 100. FIG. 2 shows two coupling members 260 that couple the handle 250 to the body, but in another implementation, the coupling members 260 shown in FIG. 2 can be a cross-sectional view of a single coupling member shaped in a ring.

The handle 250 and the coupling members 260 are designed to inhibit the transmission of vibration from the body 102 of the power tool 100 to the hand of an operator gripping the handle. The handle 250 is coupled to the tool body 102 through one or more resilient coupling members 260 that can flex and return to their original shape and orientation. The coupling members 260 can be, for example, generally cylindrically shaped and can be made of one or more resilient materials, such as, for example, steel, aluminum, hard plastic, carbon, or glass fiber, that can flex and then return to their original positions. The coupling members 260 can be integrated with the handle 250, e.g., by forming the handle and the coupling members together during an injection or blow molding process. Alternatively, the coupling members 260 can be separate components that can be secured to the handle 250, for example, by snap-fitting a top end 264 of the coupling member 260 into a recess in the handle, by gluing the top end to the handle, or by threading the top end 264 into the handle 250. Similarly, bottom ends 266 of the coupling members 260 can be fabricated integrally with the body 102 or can be separate components that can be secured to the body, for example, by snap-fitting, gluing, or threading the bottom ends into the body.

Figure 3:
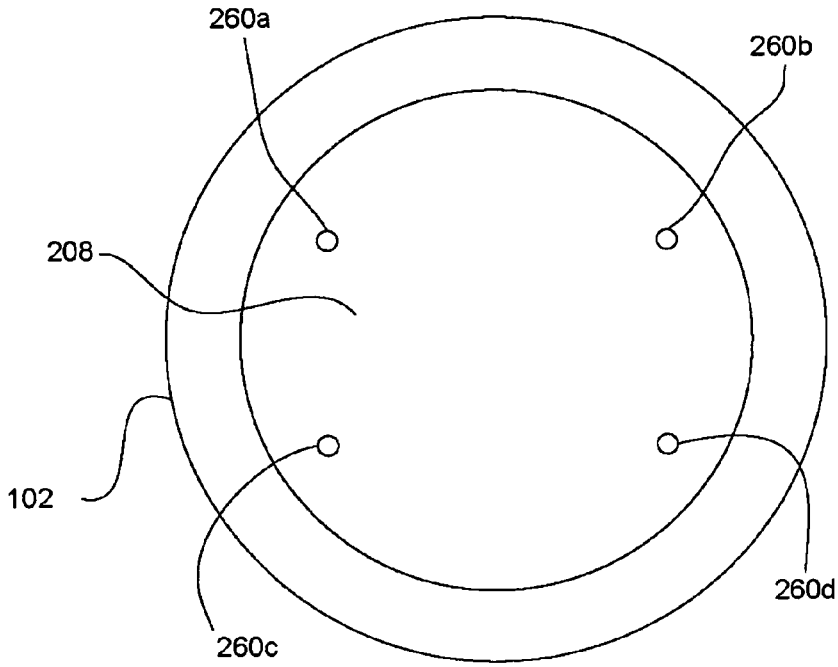
FIG. 3 is a schematic topside view of the power tool shown in FIG. 1, with the handle removed and the coupling members extending upward from a top surface of the body of the power tool.
Figure 3:
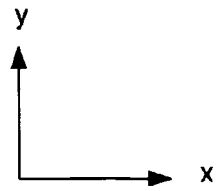

FIG. 3 is a schematic top view of the power tool 100 shown in FIG. 2, with the handle 250 removed and the coupling members 260*a*, 260*b*, 260*c*, and 260*d* extending upward from a top surface of the body 102 of the power tool. The coupling members 260*a*, 260*b*, 260*c*, and 260*d* can be arranged symmetrically or asymmetrically, and the spacing between coupling members 260*a*, 260*b*, 260*c*, and 260*d* in one direction (e.g., the y-direction) can be different than the spacing between coupling members 260*a* and 260*b* or 260*c* and 260*d* in another direction (e.g., the x-direction).

Because the handle 250 is connected to the body 102 of the power tool that is subject to vibration, vibrations generated, for example, by a moving part within the body 102 are transmitted from the body to the handle. However, with the handle 252 coupled to the body 102 by the coupling members 260, the amplitude of vibrations transmitted from the power tool body 102 to the operator's hand when the operator grips the handle and operates the tool can be reduced compared with the amplitude of vibrations experienced when operating a power tool having a handle connected rigidly to the body of the tool. For example, when the body 102 vibrates in a direction transverse to a longitudinal axis of the coupling members 260 (i.e., parallel to the bottom surface of platen 108), vibrations from the body can be transmitted through the coupling members 260 to the handle 250 and cause the handle also to vibrate in a transverse direction.

Figure 4:
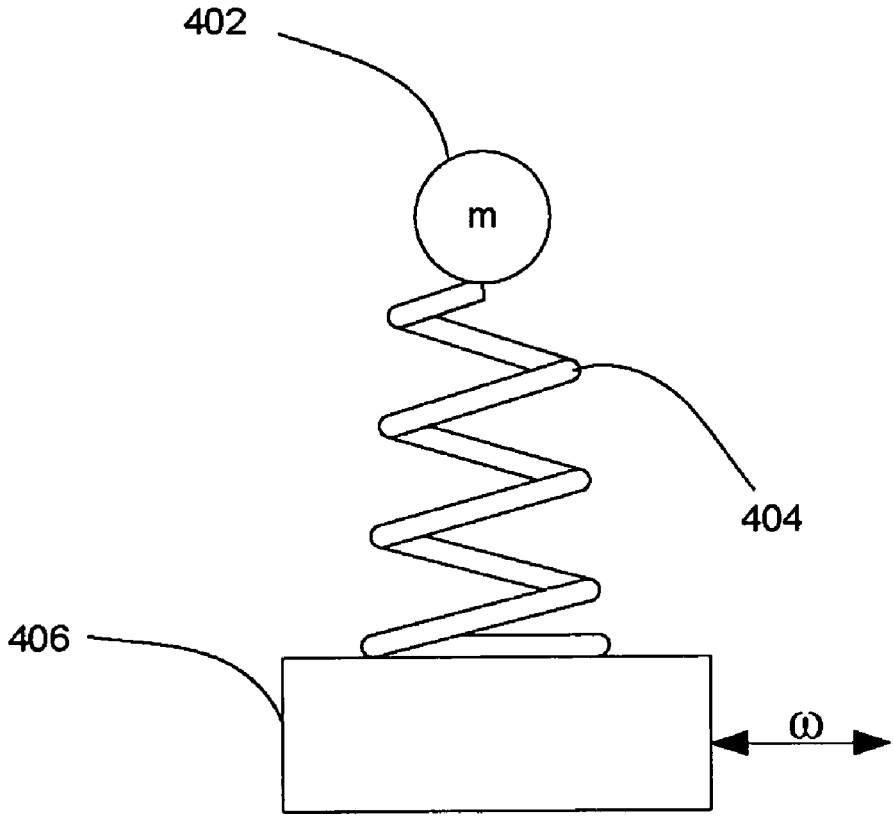
FIG. 4 is a schematic diagram of model of a system that includes a tool handle and coupling members, in which the handle is modeled as a rigid body having a mass, m, the coupling members are modeled collectively as a massless spring having a spring constant, k, and the body is modeled as a block that oscillates in one dimension at a frequency, $\omega$.

FIG. 4 is a schematic diagram of model of a system that includes the handle 250 and the coupling members 260, in which the handle is modeled as a rigid body 402 having a mass, m, the coupling members are modeled collectively as a massless spring 404 having a spring constant, k, and the body is modeled as a block 406 that oscillates in one dimension at a frequency, ω). In this model, the natural frequency, $\omega_o$, of a lowest order mode of vibration of the rigid body is $$\sqrt{\frac{k}{m}},$$

such that a resonance condition exists between the motion of the block 406 and the motion of the rigid body 402, and the amplitude of vibrations transmitted from the oscillating block 406 to the rigid body 402 is maximized, when a $\omega=\omega_o$. When $\omega>\omega_o$, the amplitude of transmitted oscillations is reduced.

Referring again to FIG. 2, to reduce the amplitude of vibrations transmitted from the body 102 of the power tool 100 to the handle 250, physical properties of the handle and the coupling members 260 can be selected so that the handle has predetermined vibrational modes with resonant or natural frequencies that do not resonate with vibrational motion of the body 102 when the power tool 100 is operated. The vibrational modes of the handle 250, and their natural frequencies, can depend on properties, such as, for example: the mass of the handle and the coupling members; the shape, center of gravity and moment of inertia of the handle and the coupling members; the modulus or stiffness of the coupling members, the number of coupling members and the positions relative to each other. When gripped by the hand of the operator, the mass of the operator's hand also may play a role in determining the natural frequencies of vibrational modes. The stiffness characteristics of the coupling members 260 can be affected by, for example, the material(s) of the coupling members, the length of the members, and the cross-sectional area of the members.

Thus, in one implementation, the natural frequencies of a first-order mode, and, optionally, also a second-order mode, of vibration of the handle 250 coupled to the body 102 through the coupling members 260 can be chosen (e.g., by appropriate selection of physical parameters of the coupling members 260 and the handle 250) to be less than a predetermined vibration frequency of the power tool 100 during operation. Excitation of the first- and second-order modes can impart substantial energy to the handle 250, and these modes typically are primary contributors to the total vibrational energy in the handle. Accordingly, vibration of the handle 250 at the natural frequencies of the first- and second-order modes is preferably avoided.

The predetermined vibration frequency of the power tool 100 during operation can be, for example, the frequency or frequency range of vibration of the power tool 100 under a loaded or no-load condition. In one implementation, when the power tool 100 is a random orbit sander that includes an orbit mechanism 104, the predetermined frequency may be the typical frequency or range of frequencies at which the sander 100 vibrates when the abrasive material 110 on the platen 108 contacts and imparts a force to the workpiece and/or when the tool runs freely and does not contact a workpiece.

By creating coupling members 260 and a handle 250 having first- and second-order natural frequencies of vibration that are less than a frequency or range of frequencies of vibration of the power tool 100 when operated under load, vibrational energy in the handle can be reduced when the power tool is operated on a workpiece. Alternatively or additionally, the first- and second-order natural frequencies of vibration of the system of the coupling members 260 and the handle 250 can be less than a frequency or range of frequencies of vibration of the power tool 100 when the tool is not under load or when the tool is run both when it is loaded and when it is not loaded.

Figure 5A:
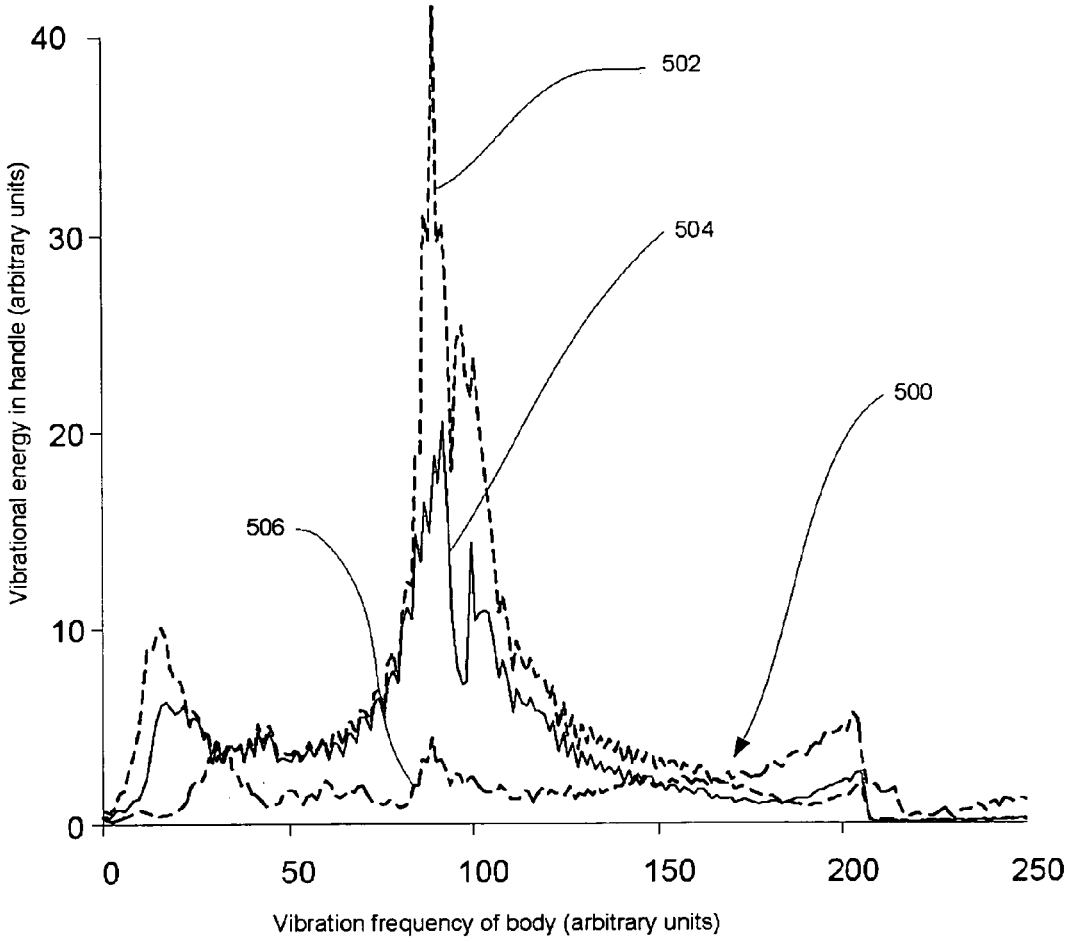
FIG. 5A is a schematic graph representing vibration data recorded from a prototype a random orbit sander having a vibration damping handle connected to the body of the sander though coupling members.

FIG. 5A is a plot of data representing the coupling of vibrational energy in the body 102 to vibrational energy in the handle 250 as a function of frequency of a prototype power tool 100 in which the handle 250 is coupled to the body 102 through semi-flexible, resilient coupling members 260. The horizontal scales are linear but use arbitrary units. The normal operating frequency of the power tool 100 may be in the range of about 140 to 180 units as shown on the plot (e.g., shown by reference numeral 500), and physical parameters of the handle 250 and coupling members 260 may be chosen such that natural frequencies of vibrational modes of the handle when grasped by a user may be less than the range of normal operating frequencies of the tool when the tool is used in typical operating conditions. For example, the energy in a vibrational mode of the handle in which the handle vibrates in the x-direction is represented by plot 502, which shows that at a first-order natural frequency of about 85 units a relatively large amount of energy is coupled from moving parts within the body 102 (e.g., the motor 112) to the handle 250. However, at the range of normal operating frequencies (indicated by reference numeral 500) relatively little energy is coupled to the handle 250. Similarly, the energy in a vibrational mode of the handle in which the handle vibrates in the y-direction is represented by plot 504, which shows that at a first-order natural frequency of about 85 units a relatively large amount of energy is coupled from the body 102 to the handle 250, but at the range of normal operating frequencies (indicated by reference numeral 500) relatively little energy is coupled to the handle. Energy in a vibrational mode of the handle in which the handle vibrates in the z-direction is represented by plot 506, which also shows that a first-order natural frequency occurs at about 85 units causing a relatively large amount of energy to be coupled from the body 102 into the vibrational motion in the z-direction. Thus, as can be seen from plots 502, 504, and 506, when the power tool 100 starts up and accelerates up to its normal operating frequency it traverses through a resonance condition in which a relatively large amount of energy is coupled from vibrations in the body 102 to vibrational motion in the handle 250. However, after the tool 100 reaches the range of its normal operating frequencies 500, the amount of energy coupled to from the body 102 to the handle 250 is much lower.

Figure 5B:
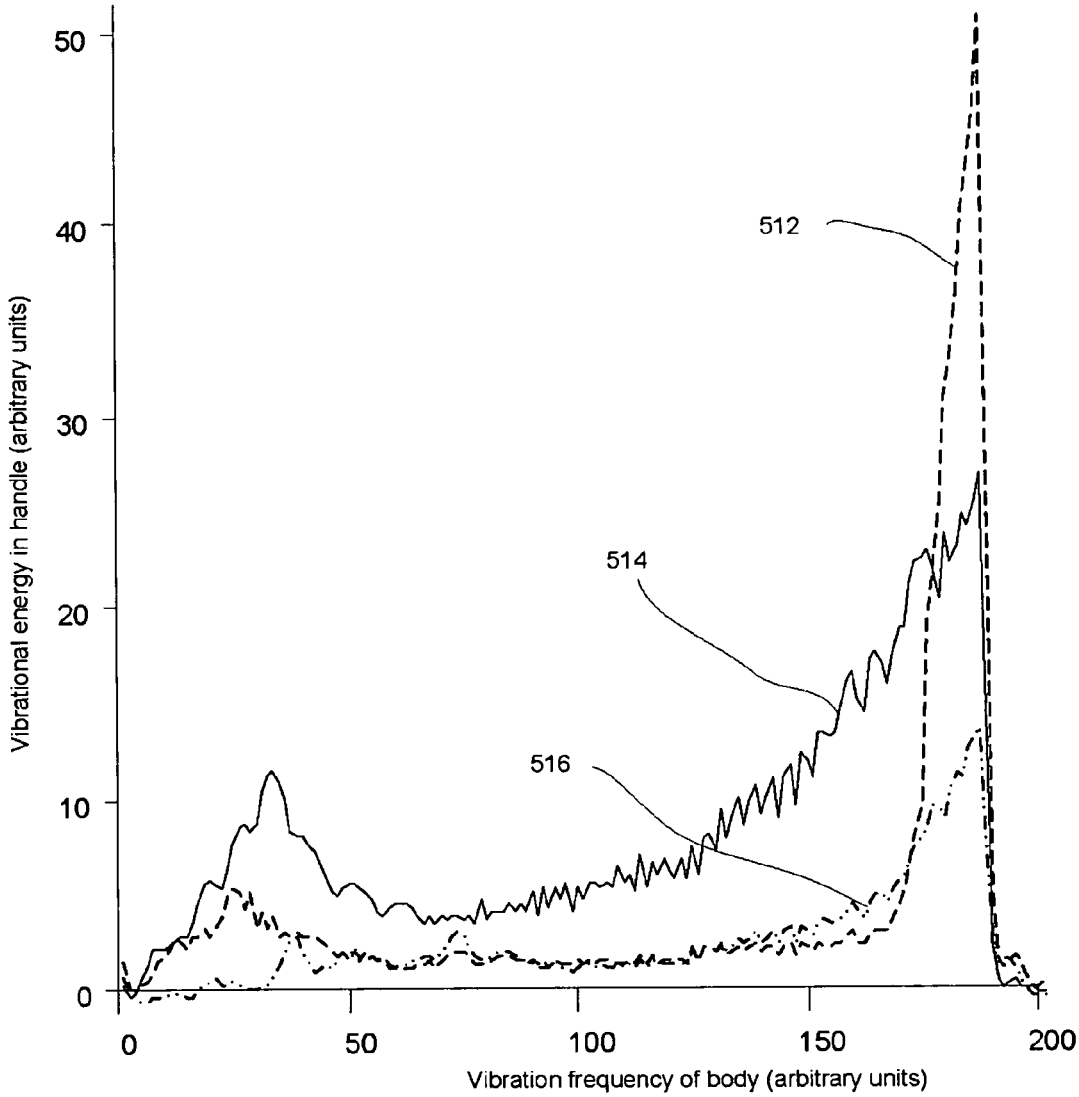
FIG. 5B is a schematic graph representing vibration data recorded from a standard random orbit sander having a handle that is rigidly connected to the body of the sander.

FIG. 5B is a plot of data representing the coupling of vibrational energy in the body to vibrational energy in the handle as a function of frequency of a standard power tool that does not include semi-flexible, resilient coupling members 260 but in which the handle is formed integrally with the body in a structure similar to that described in U.S. patent application Ser. No. 11/103,928. Energy coupled from one or more moving parts within the body to the transverse mode of the handle vibrating in the x-direction is represented by plot 512. Energy coupled from the body to the transverse mode of the handle vibrating in the y-direction is represented by plot 514. Energy coupled from the body to the longitudinal mode of the handle vibrating in the z-direction is represented by plot 516. As can be seen from plots 512, 514, and 516, the resonant frequencies of the modes occurs at over 190 units in the plot of FIG. 5B, which is close to the normal operating frequency of about 140 to 180 units for the tool. Thus, a relatively large amount of energy is coupled from moving parts within the body of a standard power tool to the handle during normal operation of the tool.

A comparison of plots 502, 504, and 506 in FIG. 5A and plots 512, 514, and 516 in FIG. 5B shows that the during normal operating conditions of the power tool, with the power tool operating at a frequency of about 140-180 units as shown in FIGS. 5A and 5B, the total energy coupled to the handle 250 of a tool that includes semi-rigid coupling members 260 can be less than the total energy coupled to the handle in a tool that does not include the coupling members 260. Therefore, by judicious choice of the physical parameters (e.g., masses, materials, shapes, and configurations) of the coupling members 260 and the handle 250 the natural frequencies of the handle-coupling member system can be controlled such that the natural frequencies do not coincide with an anticipated vibration frequency of the body 102 and relatively little vibrational energy is coupled from the body to the handle during operation. Additionally, the motor 112 can be controlled to ensure that the tool operates only very infrequently under conditions during which the vibrational frequency of the tool is close to a natural frequency of the handle-coupling member system. For example, the on/off switch 114 and the paddle switch 116 can include only settings that would allow the tool to be operated under conditions in which the vibrational frequency of the tool is sufficiently far to a natural frequency of the handle-coupling member system to keep vibrations in the handle 250 low. In another implementation, position sensors 214 within the body can provide information about the position of rotor 200 to a controller that also receives a timing signal. From the position and time information, the controller may determine the angular frequency of the rotor 200, which is related to the vibration frequency of the body. When the controller determines that the angular frequency, and therefore the vibration frequency of the body, has been sufficiently close to a natural frequency of the handle-coupling member system for longer than a predetermined timeout period, the controller may automatically shut off power to the motor 112.

Figure 6:
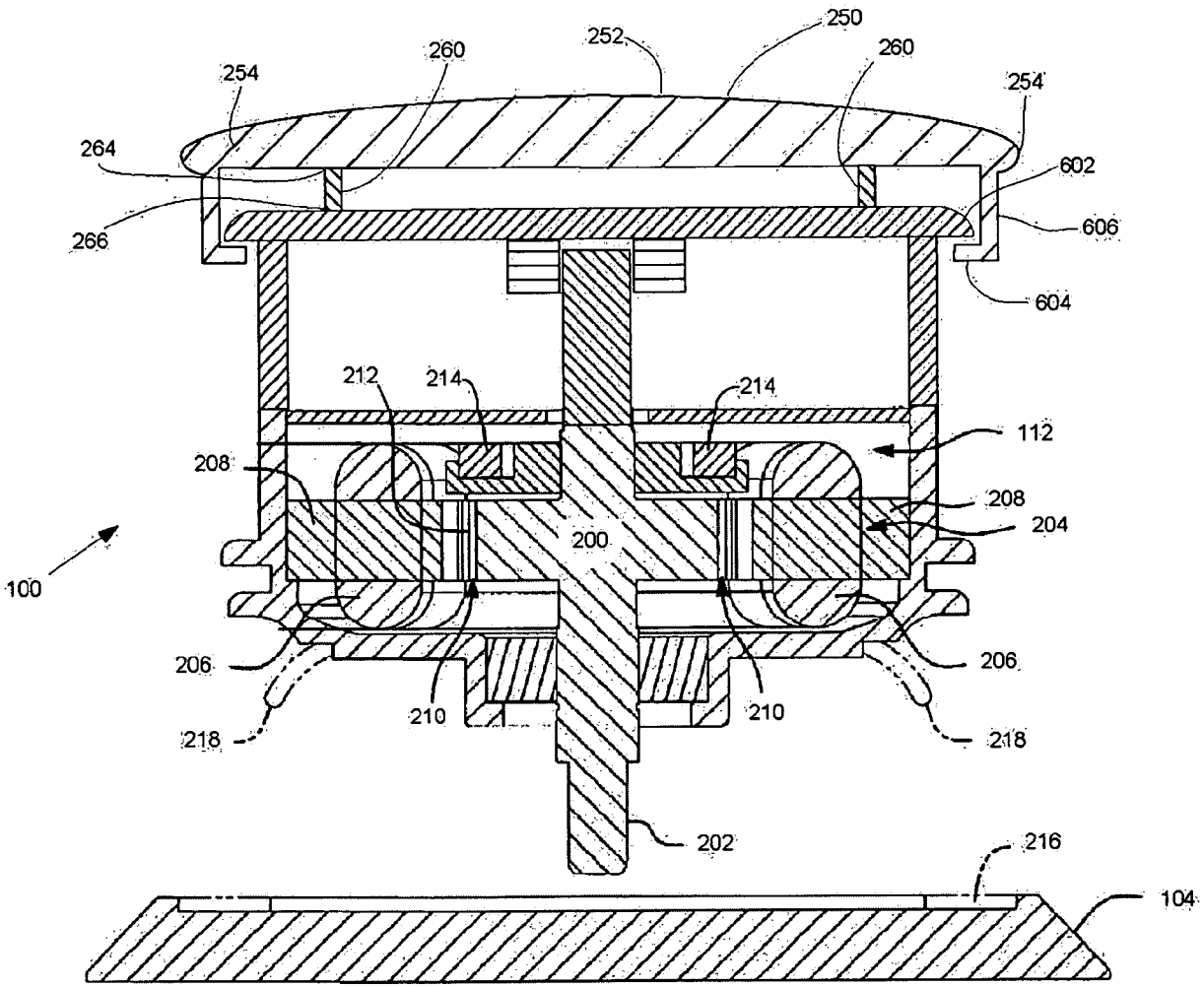
FIG. 6 is a schematic cross-sectional view of a power tool having coupling members that couple a handle to the body of the tool.

FIG. 6 is a schematic cross-sectional view of another implementation of a power tool 100 having coupling members 260 that couple a handle 250 to the body 102 of the tool. In this implementation, the body 102 includes a top flange 602 that projects outward away from the main body 102 of the tool. In addition, the handle 250 includes a bottom flange 604 attached to a downwardly-extending leg 606 of the handle and that projects inward toward the main body 102 of the tool. When the handle 250 is installed in position on the tool its flange 604 is located below the top flange 602 of the body and overlaps the top flange 602 of the body without touching the top flange. In this configuration, the top flange 602 of the body 102 and the bottom flange 604 of the handle 250 can cooperate to prevent the handle from being displaced upward away from the body beyond a predetermined distance. In addition, the configuration of the leg 606 and the flanges 602 and 604 prevent access to the space below the handle 250 and above the body 102.

Figure 7:
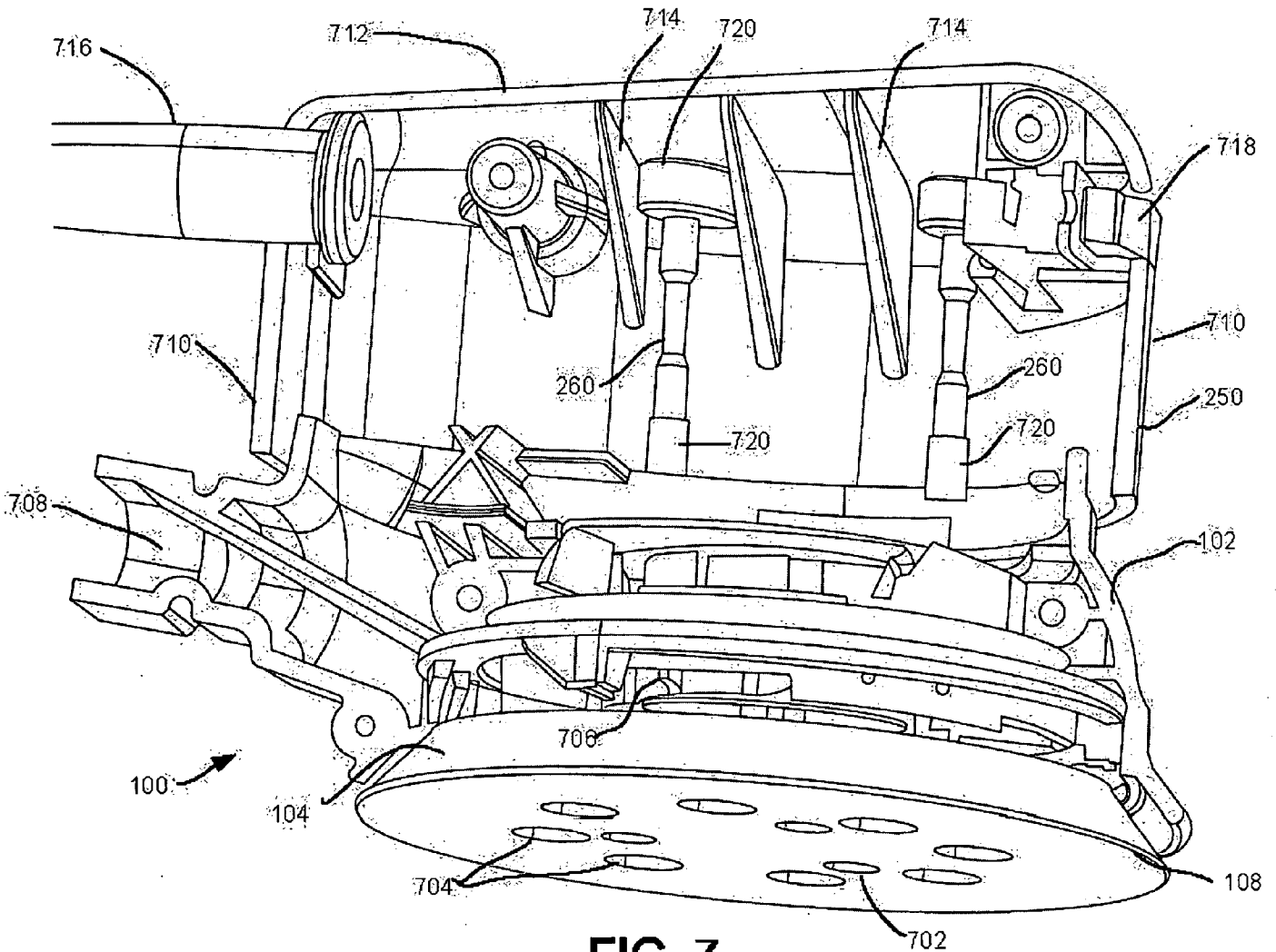
FIG. 7 is a schematic perspective view of another implementation of a power tool having coupling members that couple a handle to the body of the tool.

FIG. 7 is a schematic perspective view of another implementation of a power tool 100 having coupling members 260 that couple a handle 250 to the body 102 of the tool. The power tool 100 includes an orbit mechanism 104 that 104 supports a pad or platen 108 adapted for holding sandpaper or other abrasives or materials (e.g., polishing or buffing platens) that a user may desire to use on a workpiece. The platen 108 can be configured with a pressure sensitive adhesive or a hook-and-loop arrangement for receiving a sheet of sandpaper. The orbit mechanism 104 and the platen 108 also can include attachment holes 702 that can accept a fastener to couple the orbit mechanism 104 and the platen 108 to the tool's motor, e.g., to fasten the orbit mechanism and the platen to a drive shaft of the motor. The orbit mechanism 104 and the platen 108 can include venting holes 704 through which sanding dust can be extracted from the surface of the workpiece and exhausted to a collection unit (e.g., a dust bag or dust canister). For example, rotating fan blades 706 can create an airflow that moves dust away from the surface of the workpiece, up through the venting holes 704, and out through a channel 708 formed in the body of the tool to a collection unit. Alternatively, the orbit mechanism and the platen 108 may not include venting holes.

The power tool includes a handle 250 that has side walls 710 and a top wall 712. Stiffening ribs 714 attached between the interior sides of the top wall 712 and the side walls 710 can provide rigidity to the handle 250. A power cord 716 can be received through a side wall 710 of the handle 250 to provide electrical power to a motor of the tool, and a switch 718 on a side wall of the handle can switch the electrical power to the motor on and off.

Figure 8:
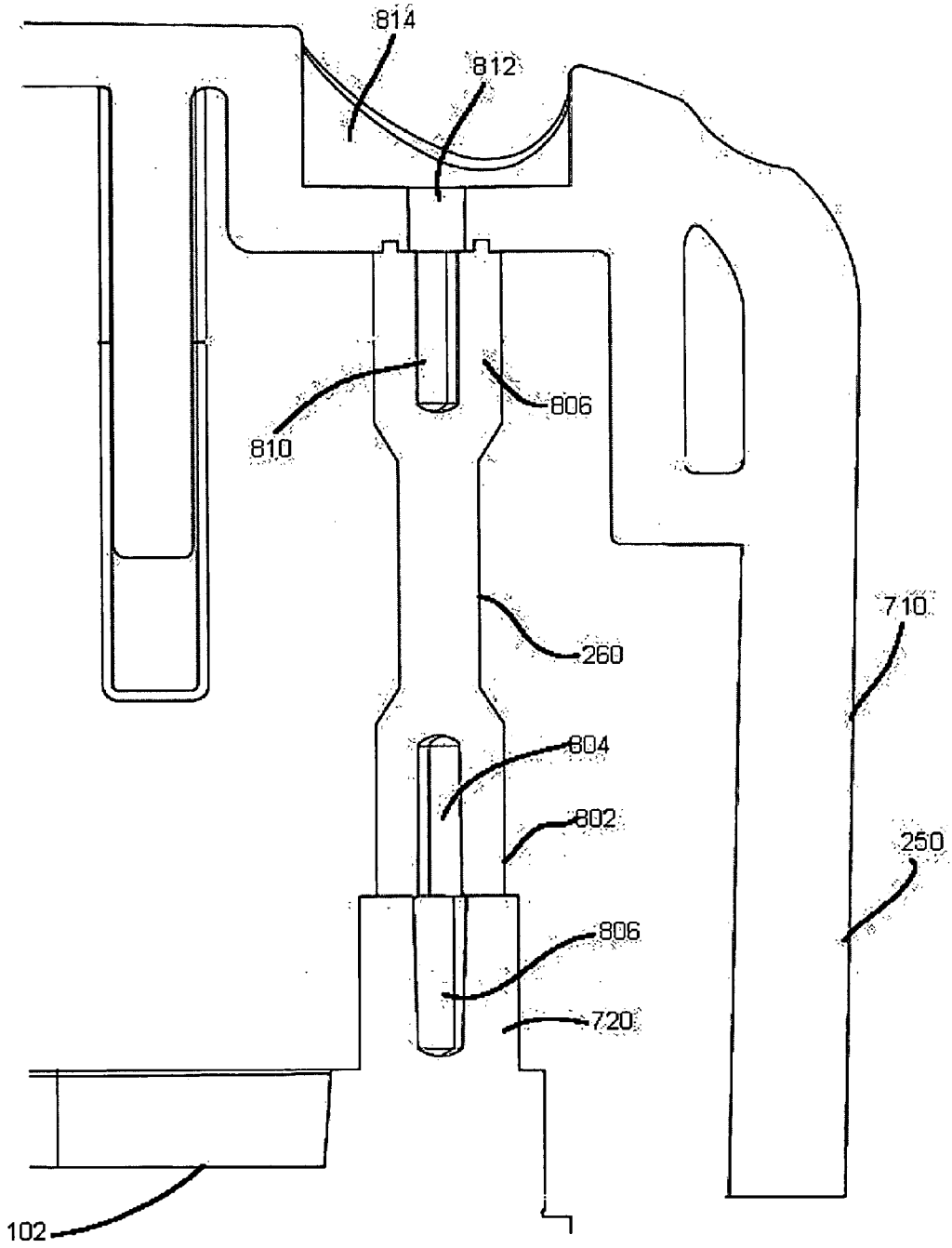
FIG. 8 is a schematic cross-sectional view of a coupling member coupling a handle to the body of a power tool.
Figure 9:
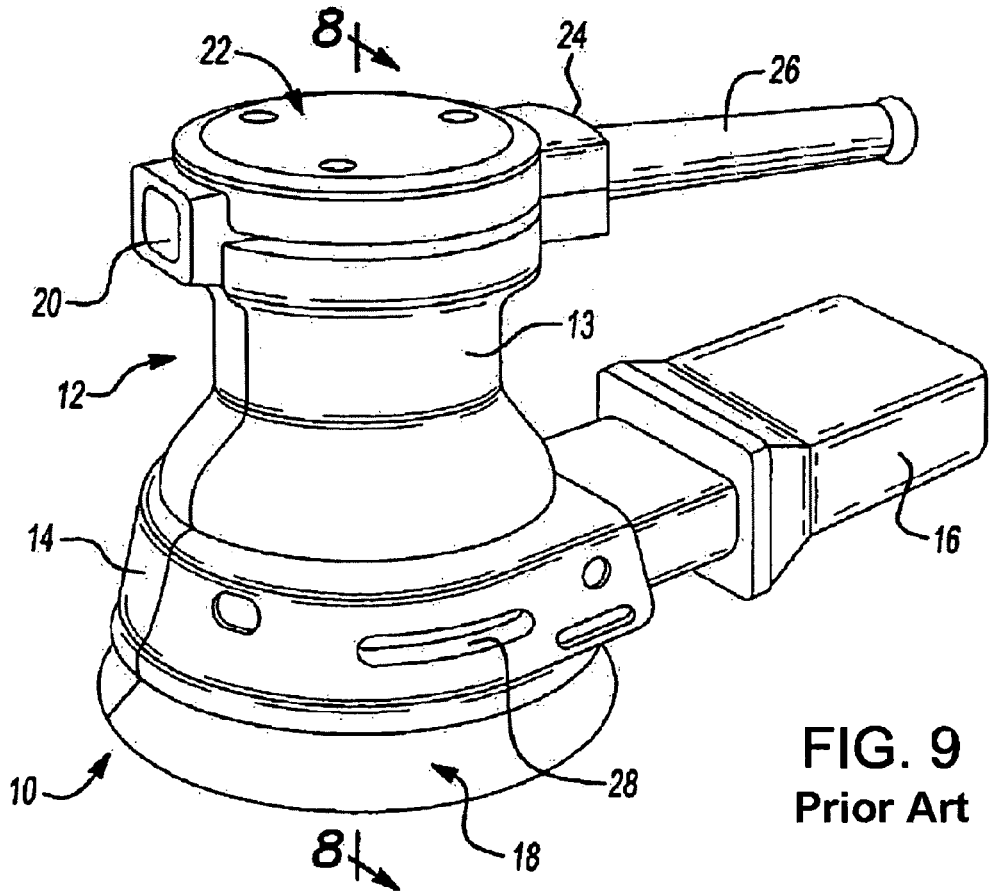
FIG. 9 Prior Art
FIG. 9 is a perspective view of a prior art random orbital sander.
Figure 10:
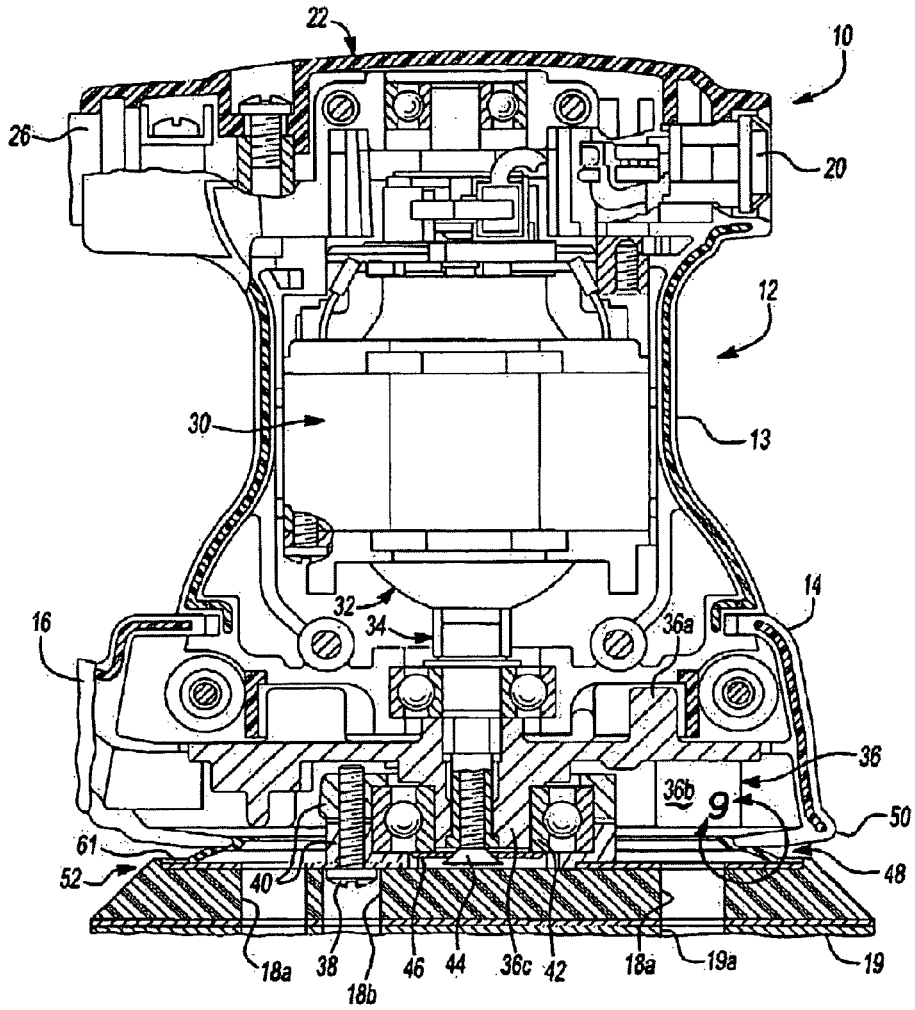
FIG. 10 Prior Art
FIG. 10 is a cross-sectional view of the sander of FIG. 9 taken along the line 8-8.
Figure 11:
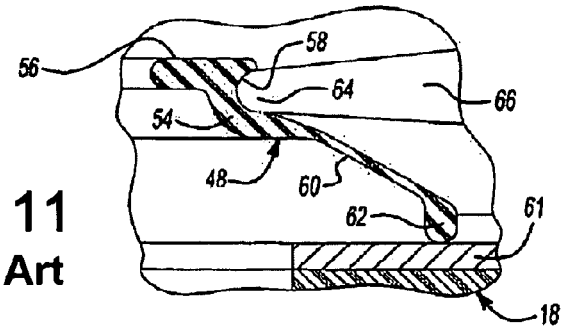
FIG. 11 Prior Art
FIG. 11 is an enlarged fragmentary view of a portion of the braking member, shroud and platen in accordance with circled area 9 in FIG. 10.

The handle 250 can be coupled to the body 102 of the tool 100 though coupling members 260 that are attached to anchors 720 on interior side of the handle 250 and on the body of the tool. As shown in the FIG. 8, which is a schematic cross-sectional view of a coupling member 260 coupling the handle 250 to the body 102 of the power tool 100, the coupling members 260 can be generally cylindrically shaped and can have a cross-section that varies along the length of the member. The dimensions and the materials of the coupling members can be selected such that during operation of the tool, a natural frequency of a first-order transverse vibrational mode of the handle when grasped by a hand of the operator is lower than primary vibration frequency of the tool. A bottom end 802 of the coupling member 260 can include a tapped portion 804 adapted to receive a threaded fastener, and an anchor 720 on the tool body 102 can similarly include a tapped portion 806 to receive the threaded fastener. Thus, the fastener can be threaded into the anchor 720, and the coupling member 260 can be treaded onto the fastener to fasten the coupling member to the body 120. Similarly, a top end 802 of the coupling member 260 can include a tapped portion 810 adapted to received a threaded fastener, and the tool body 102 can include a through hole 812 and a countersunk hole 814, such that a fastener can be inserted through the through hole and threaded into the threaded portion 810 of the coupling member 260 to fasten the handle 250 to the coupling member 260.

Although described in terms of the example embodiments above, numerous modifications and/or additions to the above-described example embodiments would be readily apparent to one skilled in the art. For example, the handle 250 can be coupled to the body 102 through one or more coupling members that have a different structure than shown in FIGS. 2, 3, and 6. In certain implementations, more or fewer than 4 coupling members could be used. The coupling members 260 could have cross sections whose diameter varies along the length of the coupling member or that are not cylindrical. The coupling member 260 could be a ring or rectangle of semi-rigid material that couples the body 102 to the handle 250. In this configuration, the ring or rectangle would constitute a single coupling member 260 between the body 102 and the handle 250 and simultaneously could function as the leg 606 that prevents access to the space between the handle 250 and the body 102.

The power tool 100 could have multiple low-vibration handles 250, such that the user could grasp a low-vibration handle with each hand, or such that the tool could be grasped at different locations, each of which features a low-vibration handle.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. A power tool comprising:

a tool body, wherein the tool body is subject to vibration during operation of the power tool;

a handle adapted to be grasped by an operator of the power tool for controlling the motion of the power tool; and at least one semi-rigid, resilient coupling member, each coupling member including a first end coupled to the tool body and a second end coupled to the handle and a longitudinal axis between the first end and the second end, wherein the at least one coupling member is configured to inhibit the transmission of vibration from the tool body to the operator grasping the handle during operation of the power tool, wherein during operation of the power tool the tool body vibrates at a primary vibration frequency, and wherein a natural frequency of a first-order transverse vibrational mode of the handle when grasped by a hand of the operator is lower than the primary vibration frequency, and wherein the at least one coupling member comprises a resilient material, such that the collective response of the coupling members to vibration can be characterized by a collective spring constant and wherein the square root of the collective spring constant divided by the mass of the handle is less than a primary vibration frequency at which the tool body vibrates during operation of the power tool.

2. The power tool of claim 1, wherein the handle comprises a top surface facing away from the tool body and being adapted to fit into the palm of a hand of the operator, such that the operator can grasp the handle with a single hand to control the movement and operation of the power tool.

3. The power tool of claim 1, further comprising:

a sanding platen adapted for receiving an abrasive material for sanding a workpiece; and a motor coupled to the sanding platen and adapted to move the platen while the operator grasps the handle.

4. The power tool of claim 3, wherein the motor is adapted to move the platen in a random orbit motion.

5. The power tool of claim 1, further comprising:

a sanding platen adapted for receiving an abrasive material for sanding a workpiece; and a fan coupled to the sanding platen; and an orifice adapted for receiving a stream of air, the stream of air being channeled within the tool body to drive the fan and cause the sanding platen to move while the operator grasps the handle.

6. The power tool of claim 1, wherein during operation of the power tool the tool body vibrates at a primary vibration frequency, and wherein a natural frequency of a second-order transverse vibrational mode of the handle when grasped by a hand of the operator is lower than the primary vibration frequency.

7. The power tool of claim 1, wherein the handle is coupled to the at least one coupling member but is separated from contact with the tool body during normal operation of the power tool.

8. The power tool of claim 1, wherein the tool body comprises a first flange extending transversely from the tool body, further comprising a second flange attached to the handle and extending substantially parallel to the first flange, and wherein the first flange is located substantially between the second flange and the handle.

9. A powered sanding tool comprising:

a tool body, wherein the tool body is subject to vibration during operation of the power tool;

a sanding platen adapted for receiving an abrasive material for sanding a workpiece;

a handle adapted to be grasped by an operator of the power tool for controlling the motion of the power tool; and at least one semi-rigid, resilient coupling member, each coupling member including a first end coupled to the tool body and a second end coupled to the handle and a longitudinal axis between the first end and the second end, wherein during operation of the power tool the tool body vibrates at a primary vibration frequency, and wherein a natural frequency of a first order transverse vibrational mode of the handle when grasped by a hand of the operator is lower than the primary vibration frequency, wherein the at least one coupling member is configured to inhibit the transmission of vibration from the tool body to the operator grasping the handle during operation of the power tool, and wherein the at least one coupling member comprises a resilient material, such that the collective response of the coupling members to vibration can be characterized by a collective spring constant and wherein the square root of the collective spring constant divided by the mass of the handle is less than a primary vibration frequency at which the tool body vibrates during operation of the power tool.

10. The power sanding tool of claim 9, wherein the handle comprises a top surface facing away from the tool body and being adapted to fit into the palm of a hand of the operator, such that the operator can grasp the handle with a single hand to control the movement and operation of the power tool.

11. The power sanding tool of claim 9, further comprising:

a motor coupled to the sanding platen and adapted to move the platen while the operator grasps the handle.

12. The power sanding tool of claim 11, wherein the motor is adapted to move the platen in a random orbit motion.

13. The power sanding tool of claim 11, wherein the motor is adapted to move the platen in a random orbit motion.

14. The power sanding tool of claim 9, further comprising:

a fan coupled to the sanding platen; and an orifice adapted for receiving a stream of air, the stream of air being channeled within the tool body to drive the fan and cause the sanding platen to move while the operator grasps the handle.

15. The power sanding tool of claim 9, wherein during operation of the power tool the tool body vibrates at a primary vibration frequency, and wherein a natural frequency of a second order transverse vibrational mode of the handle when grasped by a hand of the operator is lower than the primary vibration frequency.

16. The power sanding tool of claim 15, wherein displacement of the handle in the first- and second-order vibrational modes is substantially transverse to a longitudinal axis of an elongated coupling member.

17. The power sanding tool of claim 9, wherein the tool body comprises a first flange extending transversely from the tool body, further comprising a second flange attached to the handle and extending substantially parallel to the first flange, and wherein the first flange is located substantially between the second flange and the handle, and wherein the handle is separated from contact with the tool body during normal operation of the power tool.

* * * * *